US006188375B1

(12) United States Patent
Kagey

(10) Patent No.: US 6,188,375 B1
(45) Date of Patent: Feb. 13, 2001

(54) PIXEL DRIVE CIRCUIT AND METHOD FOR ACTIVE MATRIX ELECTROLUMINESCENT DISPLAYS

(75) Inventor: Danny R. Kagey, Columbia, MD (US)

(73) Assignee: Allied Signal Inc., Morristown, NJ (US)

( * ) Notice: Under 35 U.S.C. 154(b), the term of this patent shall be extended for 0 days.

(21) Appl. No.: 09/133,202

(22) Filed: Aug. 13, 1998

(51) Int. Cl.[7] ..... G09G 3/30

(52) U.S. Cl. ..... 345/76; 345/77; 345/78; 345/79; 345/80; 345/81

(58) Field of Search ..... 345/76, 78, 77, 345/79, 80, 81

(56) References Cited

U.S. PATENT DOCUMENTS

| | | | | |
|---|---|---|---|---|
| 5,302,966 | | 4/1994 | Stewart | 345/76 |
| 5,952,789 | * | 9/1999 | Stewart et al. | 315/169.4 |
| 5,986,628 | * | 11/1999 | Tuenge et al. | 345/76 |

* cited by examiner

*Primary Examiner*—Richard A. Hjerpe
*Assistant Examiner*—Jean E. Lesperance
(74) *Attorney, Agent, or Firm*—Kris T. Fredrick

(57) ABSTRACT

An AMEL display is formed and operated in a manner to provide enhanced gray scale or color operation. The AMEL display is operated over consecutive illumination frames which are partitioned into a plurality of passes. The desired illumination intensity for a given pixel during each illumination frame is determined and the pixel is activated for a substantially equal duration in each pass to provide the desired illumination level for each frame. Each pass has an associated illumination profile signal composed of a plurality of discrete steps for selectively passing a number of illumination pulses to each active EL cell in the display in accordance with a pixel activation voltage loaded into each active EL cell. The pixel activation voltage and illumination profiles cooperate to distribute the number of illumination pulses in a substantially equal fashion in each pass of an illumination frame. Pixel driver circuits are disclosed for operating the pixel in accordance with the disclosed illumination methods.

2 Claims, 4 Drawing Sheets

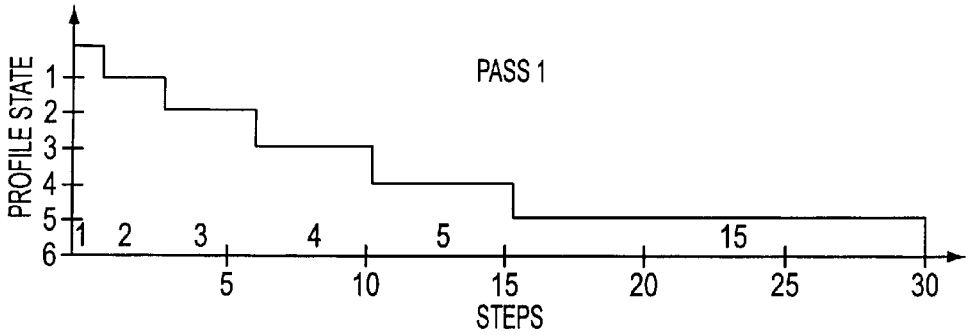
FIG. 6A
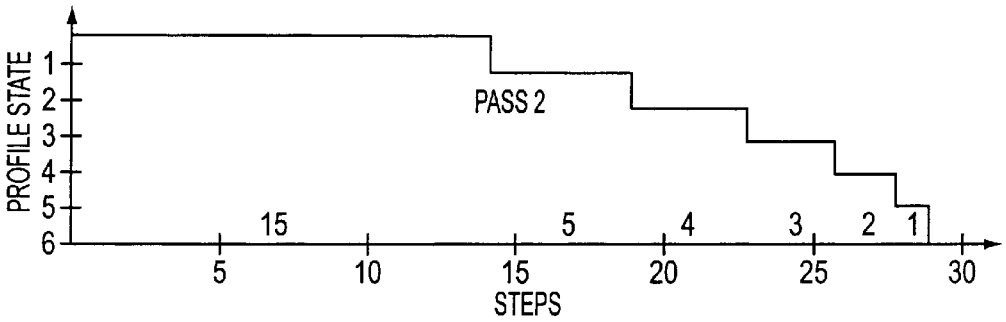
FIG. 6B
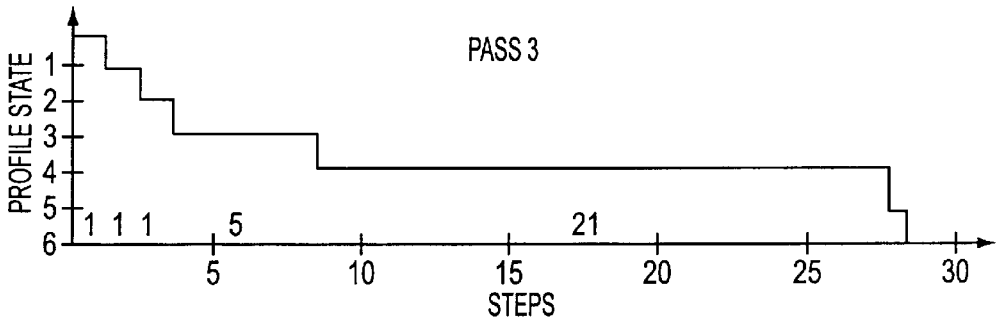
FIG. 6C
| | | PULSES PER STATE | | |
|---|---|---|---|---|
| PROFILE STATE | $V_{DC}$ | PASS 1 (FIG. 6A) | PASS 2 (FIG. 6B) | PASS 3 (FIG. 6C) |
| 1 | 2.3 | 1 | 15 | 1 |
| 2 | 2.6 | 2 | 5 | 1 |
| 3 | 2.9 | 3 | 4 | 1 |
| 4 | 3.2 | 4 | 3 | 5 |
| 5 | 3.5 | 5 | 2 | 21 |
| 6 | 3.8 | 15 | 1 | 1 |
| TOTAL | | 30 | 30 | 30 |
FIG. 6D

PIXEL DRIVE CIRCUIT AND METHOD FOR ACTIVE MATRIX ELECTROLUMINESCENT DISPLAYS

BACKGROUND OF THE INVENTION

1. Field of the Invention

The present invention relates generally to active matrix electroluminescent (AMEL) displays, and more particularly relates to an AMEL pixel driving circuit and quasi-analog method of operating same for improved gray scale and color operation.

2. Description of the Related Art

Thin film electroluminescent (EL) displays are well known in the art and are typically used for flat screen displays in a variety of applications. A typical display includes a plurality of pixels arranged in an array of rows and columns. Each pixel comprises an electroluminescent phosphorus active layer interposed between a pair of insulators and a pair of electrodes. A typical embodiment is a 640×480 pixel array placed in a 0.75 inch square area for use in heads-up displays and the like.

The pixels in a conventional AMEL display are either active (illuminated) or inactive (dark) at any given time. To generate shades of gray, typical AMEL displays are operated in a time multiplexed mode. Referring to FIG. 1, prior art AMEL displays generally include a driver circuit at each pixel comprising a first transistor 100 having a gate connected to a select line 110, a source connected to a data line 108 and a drain connected to a gate of a second transistor 102 and through a first capacitor 104 to an AC ground potential. A source of the second transistor 102 is connected to a ground terminal, a drain is connected to one electrode of an EL cell 106. A second electrode EL cell 106 is connected to a high voltage alternating current source (AC Source) 112 for excitation of the phosphor in the EL cell 106.

A conventional AMEL pixel is operated in consecutive time frames. During a first portion of a time frame (load cycle) a digital signal is consecutively applied to all data lines 108 in the display. For those pixels which will be active, the corresponding select lines 110 are strobed consecutively by row. This turns on transistor 100 thereby allowing charge from data line 108 to accumulate on capacitor 104 and on the gate of transistor 102, thereby turning transistor 102 on. The charge is stored in capacitor 104 when the select line 110 returns to an inactive state. At the completion of the load cycle, the second transistor 102 associated with each activated pixel is on. During a second portion of the frame (illumination cycle), the AC source 112 is applied to all pixels in the display. Current flows from the AC source 112 through the EL cell 106 and the transistor 102 to ground in each activated pixel. This produces an electroluminescent light output from each activated EL cell 106. For each load/illuminate frame, each pixel is either on or off. Therefore, gray scale operation is only achieved by time multiplexing the pixel over a sequence of multiple load/illumination frames and allowing the eye to integrate the light pulses into a gray image.

Efforts have been made in the prior art to improve the gray scale operation of AMEL display devices. For example, U.S. Pat. No. 5,302,966 to Stewart discloses an AMEL display that employs an analog driving technique for each pixel. FIG. 2 illustrates one embodiment disclosed in the Stewart patent. This circuit includes a first transistor 200 having a gate terminal coupled to a select line 210, a drain terminal connected to a data line 208 and source terminal connected to the gate terminal of a second transistor 202. The source terminal of the first transistor 200 is also connected to capacitor 204 which has a second terminal coupled to circuit ground. The second transistor 202 has a source terminal connected to the data line 208 and a drain terminal connected to an EL cell 206. The EL cell 206 is further connected to an AC source 212.

As with the driver circuit of FIG. 1, the circuit of FIG. 2 operates in consecutive frames having load/illuminate cycles. However, during the load cycle, an analog voltage is applied to the data line 208 and this analog voltage is stored in capacitor 204 when an active pixel receives a row select strobe. During the subsequent illumination cycle, the data line receives an analog ramp signal. So long as the ramp signal has a voltage potential less than the voltage stored in capacitor 204 (minus a threshold), transistor 202 conducts, thereby illuminating EL cell 206. When the ramp voltage on the data line exceeds the stored voltage in capacitor 204 minus the threshold, transistor 202 turns off and current no longer flows through EL cell 206. Therefore, El cell 206 is only operating during a portion of each illumination cycle, thus providing a variable illumination period during each frame which provides gray scale operation.

To achieve 64 levels of gray scale using the method of the Stewart patent, all of the transistors in the AMEL driver circuit of FIG. 2 must consistently respond to a small change in voltage equal to $(V_{DD}-V_{DMOS})/64$, where $V_{DMOS}$ is a threshold voltage where the transistors are active. For a threshold voltage of 2 volts and $V_{DD}$ of 5 volts, the resolution of each voltage step is about 47 millivolts. However, current manufacturing technology and the errors related to high voltage coupling components do not provide sufficient uniformity across the AMEL display substrate to support this requirement. Therefore, the step size must be increased either by using non-conventional power supply voltages or by reducing the number of gray scale steps of the display.

The operation of the AMEL display in accordance with the Stewart patent also supplies a highly non-uniform current versus time profile. When only the least significant bit is active, the EL cell 206 will be active for only 1 out of 32 pulses. When the most significant bit (MSB) is active, the EL cell will be active for all 32 pulses. This broad range of duty cycle (32:1) makes power recovery techniques impractical, thereby reducing the overall operating efficiency of the display.

Therefore, there remains a need for an improved AMEL display. Such a display shall feature a more uniform activation profile and also feature increased step size for a given resolution of gray scale operation. Such circuits and methods will also be applicable to color displays as well as monochrome displays.

SUMMARY OF THE INVENTION

In accordance with a first embodiment of the present invention, a pixel driver circuit for an AMEL display has a first transistor with a gate terminal coupled to a row select line, a source terminal coupled to a data column line and a drain terminal coupled to a gate terminal of a second transistor. A capacitor is coupled from the gate terminal of the second transistor to a profile voltage input terminal. The second transistor has a source terminal connected to a circuit ground terminal and a drain terminal connected to an electroluminescent cell. The electroluminescent cell is also coupled to a voltage high AC source input terminal.

In accordance with another embodiment of the present invention, a pixel driver circuit for an AMEL display includes a first transistor with a gate terminal coupled to a row select line, a source terminal coupled to a data column line and a drain terminal coupled to a gate terminal of a second transistor. A capacitor is coupled from the gate terminal of the second transistor to a circuit ground terminal. The second transistor has a source terminal connected to the profile voltage input terminal and a drain terminal connected to an EL cell. The EL cell is also coupled to a high voltage AC source input terminal.

A method of operating an electroluminescent cell in accordance with the present invention includes the steps of dividing an illumination frame into a plurality of passes; determining the desired illumination intensity for a given pixel during said illumination frame; and activating the pixel for a substantially equal duration in each pass to provide the desired gray scale level for each frame.

In accordance with a further method of the present invention, each frame is divided into three passes. Each pass has an associated illumination profile for selectively passing a number of illumination pulses to each active EL cell in accordance with a pixel activation voltage loaded into each active EL cell. The pixel activation voltage and illumination profiles cooperate to distribute the number of illumination pulses in a substantially equal fashion in each pass within an illumination frame.

These and other objects, features and advantages of the present invention will become apparent from the following detailed description of illustrative embodiments thereof, which is to be read in connection with the accompanying drawings.

BRIEF DESCRIPTION OF THE DRAWINGS

The invention will be described in detail in the following description of preferred embodiments with reference to following figures, wherein:

FIGS. 6A–6C are graphs illustrating exemplary illumination profile drive voltages formed in accordance with the present invention; and FIG. 6D is a table further illustrating the operation of the illumination profile drive voltages of FIGS. 6A–6C.

DETAILED DESCRIPTION OF PREFERRED EMBODIMENTS

The present invention relates to circuits and methods for attaining enhanced performance in AMEL displays. An AMEL display is composed of plurality of pixels arranged in a row/column format. The number of pixels determines the viewing resolution. An array of 640 rows by 480 columns of pixels is a typical embodiment of such a display.

Figure 1:
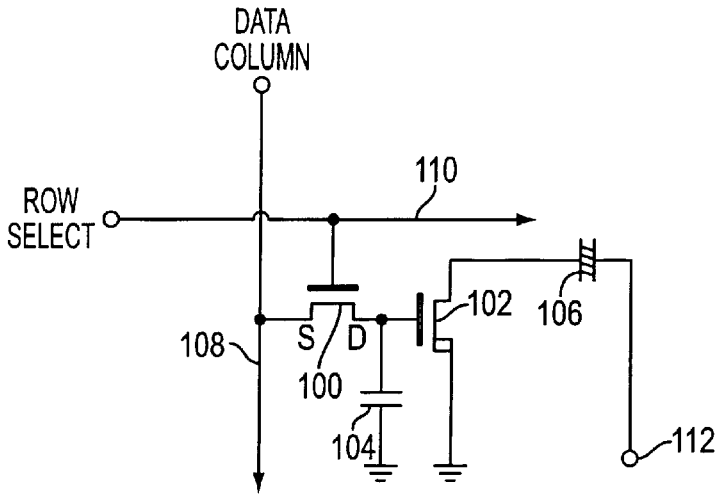
FIG. 1 (PRIOR ART)
FIG. 1 is a schematic diagram illustrating an electroluminescent cell driver circuit known in the prior art.
Figure 2:
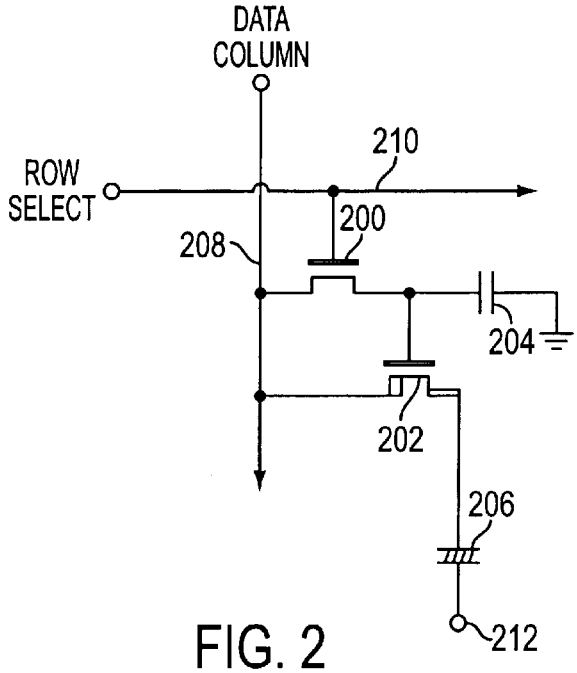
FIG. 2 (PRIOR ART)
FIG. 2 is a schematic diagram illustrating an analog electroluminescent cell driver circuit known in the prior art.
Figure 3:
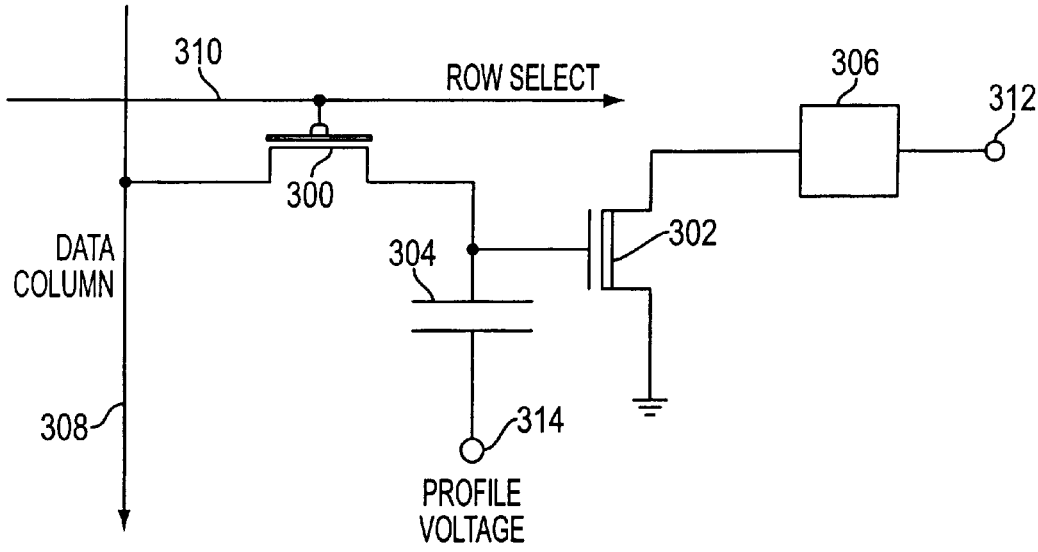
FIG. 3 is a schematic diagram of a first embodiment of an electroluminescent cell driver circuit formed in accordance with the present invention.

FIG. 3 is a schematic diagram illustrating one pixel and associated decoder/driver circuit (hereinafter driver circuit) formed in accordance with the present invention. The driver circuit includes a first FET transistor 300 having a gate terminal coupled to a row select line 310 and a source terminal connected to a data column line 308. The first transistor 300 further includes a drain terminal coupled to a gate terminal of a second transistor 302 and to a profile voltage input terminal 314 through a capacitor 304. The second transistor 302 has a source terminal coupled to a circuit ground terminal and a drain terminal coupled to an electroluminescent (EL) cell 306. The EL cell 306 is further connected to an AC voltage input terminal 312.

The circuit of FIG. 3 operates in the following manner. During a load cycle, the profile voltage terminal 314 is held at an initial voltage. A pixel activation voltage is then applied to each data column line 308 in this display. For each active pixel, the corresponding row select line 310 is strobed with an enable signal. The enable signal on the row select line turns on the first transistor 300 allowing the voltage signal on the data column line 308 to be applied to, and stored in, capacitor 304 as the row select returns to its inactive state. During an illumination cycle, a series of illumination pulses, which are high potential AC voltage pulses, are applied to terminal 312. When the voltage from gate to source of the second transistor 302 exceeds $V_{DMOS}$, the second transistor 302 is turned on and the illumination pulses are passed through EL cell 306, thereby illuminating the EL cell 306.

The voltage applied to the profile voltage terminal 314 during the illumination cycle is altered in accordance with a method of the present invention. As the illumination profile voltage is brought to a negative potential, the voltage on the gate of the second transistor 302 is pulled down. When the applied illumination profile voltage draws the gate voltage below $V_{DMOS}$, the second transistor 302 turns off, thereby turning off EL cell 306. By applying a time varying voltage function to the profile voltage input terminal 314, the duration when transistor 302 is turned on, and consequently the number of illumination pulses passed through EL cell 306, is well controlled.

Figure 4:
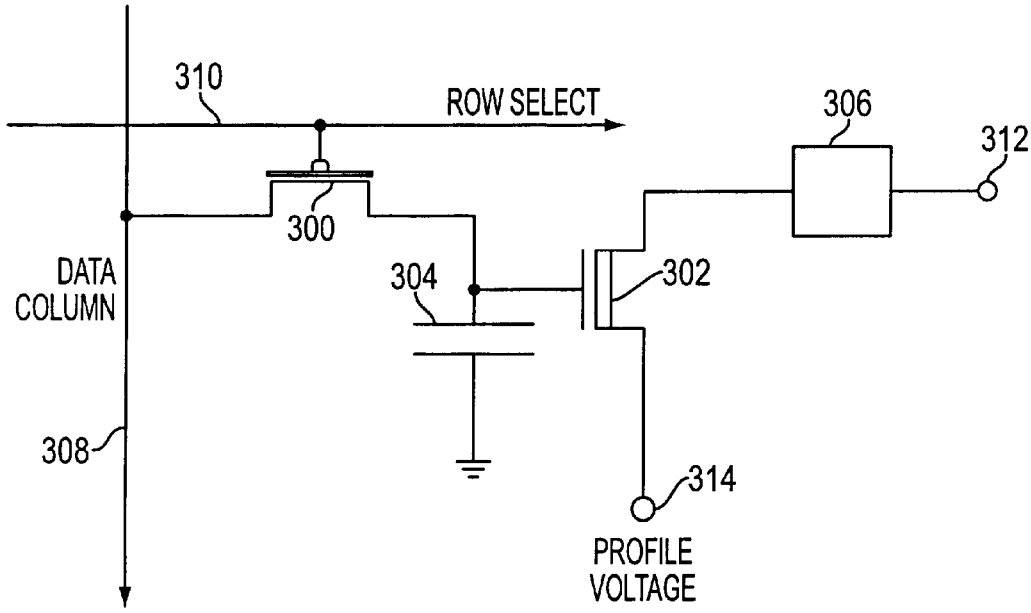
FIG. 4 is a schematic diagram of an alternate embodiment of an electroluminescent cell driver circuit formed in accordance with the present invention.

FIG. 4 illustrates an alternate driver circuit embodiment formed in accordance with the present invention. The circuit of FIG. 4 is similar to that of FIG. 3 except that capacitor 304 is now coupled to a circuit ground terminal instead of to the profile voltage terminal and the source of the second transistor 302 is now coupled to profile voltage terminal 314 rather than circuit ground. The operation of the circuit of FIG. 4 is as follows. During a load cycle, a voltage is applied to the data column line 308 which is strobed into capacitor 304 upon receipt of a row select strobe enable signal. As with FIG. 3, this voltage is stored in capacitor 304, thereby turning on second transistor 302 so long as $V_{GS}$ is greater than $V_{DMOS}$.

During the illumination cycle, the illumination pulses are passed through transistor 302. The voltage applied to profile voltage input terminal 314 is increased during the illumination cycle from an initial voltage. When the illumination profile voltage reaches a value such that $V_{GS}$ is less than or equal to $V_{DMOS}$, transistor 302 is turned off and the EL cell 306 no longer illuminates.

The circuits of FIGS. 3 and 4 include a profile voltage input terminal 314.

This is a common connection for all pixels in the AMEL display. Accordingly, this connection in the display can be formed using a shield layer in the display which presents an AC ground for shielding purposes yet passes the relatively low frequency illumination profile voltage signals to each pixel in the display.

Figure 5A:
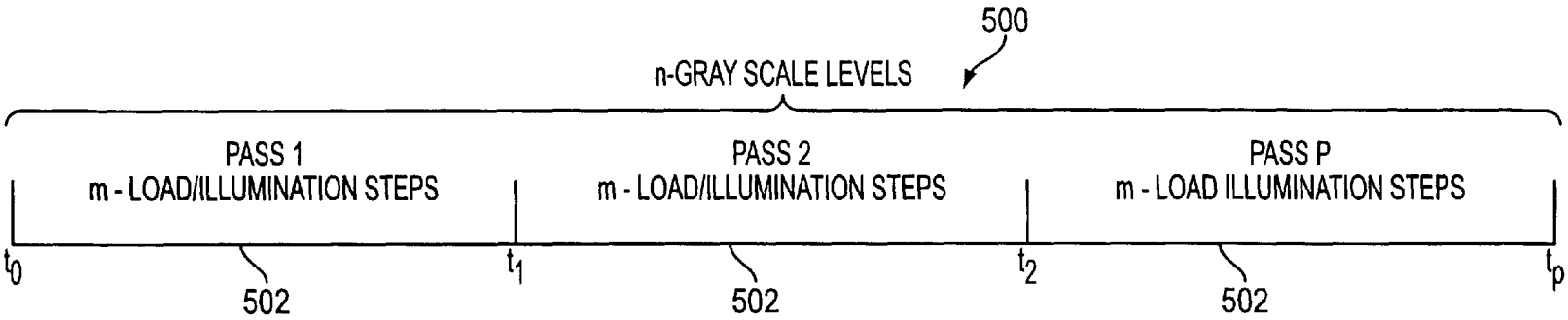
FIGS. 5A and 5B are timing diagrams illustrating an illumination frame and illumination pass, respectively, in accordance with the present invention.
Figure 5B:
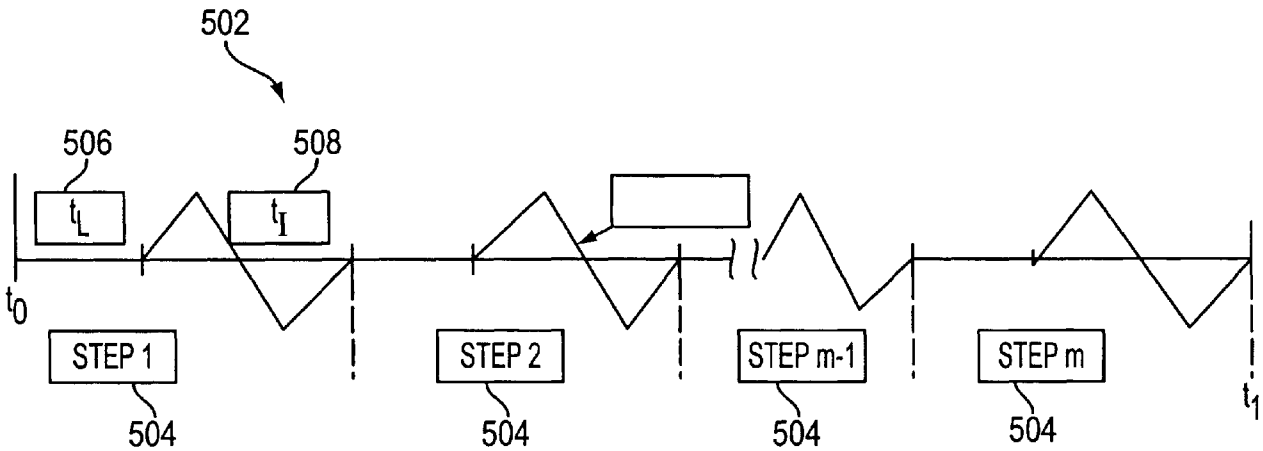

Preferably, the circuits of FIGS. 3 and 4 are operated in accordance with a method of the present invention such that high resolution gray scale or color operation is achieved with fairly large voltage step sizes applied to the illumination profile voltage input terminal 314 and a substantially uniform illumination duty cycle within a given illumination frame. Referring to FIG. 5A, a method of the present invention begins with a step of partitioning a frame 500, consisting of n gray scale levels, into a plurality of passes (P) 502. Each pass 502 has a substantially equal time period. For each pixel, the desired gray scale level (G) for given frame is then determined ($0 \leqq G \leqq N$). The gray scale level, G, is then divided and distributed in a substantially equal manner by the number of passes (P) 502 in the frame. The pixel is then illuminated by a number of illumination pulses substantially equal to the value determined by G/P.

Each pass 502 is further characterized as having an equal number (m) of load/illumination steps 504. Referring to Figure SB, each step 504 has a first time period 506, $t_l$, where a pixel activation voltage is loaded into the pixel driver circuit and is stored in capacitor 304 in a manner previously described. Each step 504 is also characterized by a second time period 506, $t_i$, which corresponds to the time period of one illumination pulse.

The operation of EL cell 306 in accordance with the method of the present invention will be described in the context of an example of a 64 bit gray scale pixel driven by the circuit of FIG. 3. In this example, each frame is divided into three passes 502 having thirty (30) steps 504 each. For each pass 502, an illumination profile voltage signal is created with a discrete number of voltage levels (states) which is less than n. Referring to FIGS. 6A–6C, exemplary illumination profile voltage signals are illustrated for each pass in this exemplary embodiment of a 64 bit gray scale AMEL display. Each illumination profile signal includes six (6) discrete voltage steps. In this example, each step corresponds to a 300 millivolt voltage change, resulting in a total voltage change for each voltage profile signal of 1.8 volts, which is well within the 2.0–2.5 volt margin $V_{DMOS}$ currently attainable in today's AMEL displays. The illumination profile voltage signals are selected such that between 0 and 64 illumination pulses can be applied to the EL cell 306 in a substantially equally distributed manner during each pass 502. An illumination pulse is applied to the EL cell 306 for each step 504 where an applied voltage profile signal maintains transistor 302 in an on condition.

FIG. 6D is a table illustrating the number of illumination pulses corresponding to each profile state for the three exemplary voltage profile signals illustrated in FIGS. 6A–6C. The number of pulses conducted through an EL cell 306 is the cumulative value for the selected state and all prior states. To illuminate a pixel for a given number of illumination pulses, profile states are selected for each of the three voltage profiles that will allow a substantially equal number of pulses to be applied to the EL cell 306 in each pass while achieving the desired total number of illumination pulses for the desired gray scale level (G). For example, to illuminate a pixel to gray scale level 33 out of 64, the pixel can be activated for 10 of 30 steps in pass one, 15 of 30 steps in pass 2, and 8 of 30 steps in pass three. This requires maintaining transistor 302 in an on condition for profile states 1–4 during pass one, for profile state 1 in pass two and for profile states 1–4 during pass three.

Assuming for example that $V_{DMOS}$=2VDC, a pixel activation voltage of 3.2 volts ($V_{DMOS}$+(4×0.3)), corresponding to profile state four (4) is loaded into capacitor 304 during each load cycle 506 of pass one. When the illumination profile voltage signal of pass one (FIG. 6A) is in state one, the illumination profile voltage signal is at 0 volts DC. In this state, $V_{GS}$ of transistor 302 is equal to 3.2 volts and transistor 302 conducts for one illumination pulse. In profile state two (2), the illumination profile voltage signal is equal to −0.3 VDC and $V_{GS}$ is equal to 2.9 volts, still allowing the transistor 302 to conduct and pass two additional illumination pulses. In state three (3), the illumination profile voltage signal is equal to −0.6 volts and $V_{GS}$ equals 2.6 volts. As this is still greater than $V_{DMOS}$, three additional illumination pulses pass through EL cell 306. During the fourth state, the illumination profile voltage signal is equal to −0.9 volts, $V_{GS}$ equals 2.3 volts, and four additional illumination pulses flow through EL cell 306 for a total of ten pulses. In the fifth and sixth profile states, $V_{GS}$ is less than $V_{DMOS}$ and the remaining 20 pulses of pass one (1) are not conducted through transistor 302. Therefore, during pass one (1), EL cell 306 is illuminated for 10 out of 30 illumination pulses.

The operation for passes two and three is similar to that of pass one except that the number of pulses associated with each profile state change in accordance with the associated illumination profile voltage signals. The illumination profile voltage signals illustrated in FIGS. 6A–6C provide for continuous integer combinations from 0–64 pulses. While several values in this range can be obtained through several different combinations, the combination that achieves the most uniform distribution of pulses for each pass 502 in a given frame 500 is a preferred combination.

The operation of the circuit of FIG. 4 is analogous to that of FIG. 3 except that the illumination profile voltage signals of FIGS. 6A–6C increment over time rather than decrement for each change in profile state. For example, the illumination profile voltage would be equal to 0 volts for state one, 0.3 volts for state two and 0.6 volts for state three, up to 1.8 volts for state six (6). Therefore, to activate transistor 302 for three activation states with $V_{DMOS}$=2V, a pixel activation voltage of 2.9 volts would be loaded into capacitor 304. When the illumination profile voltage signal reaches a level where $V_{GS}$ is less than $V_{DMOS}$, transistor 302 turns off, thereby inhibiting the flow of illumination pulses through EL cell 306.

The example described provides 64 levels of gray scale using only six discrete voltage steps. By using such relatively course steps, sufficient margins are maintained between profile states to insure that any non-uniformity in the AMEL display does not adversely affect the illumination characteristics of the display. In addition, the on/off duty cycle within each frame is now substantially equally distributed, thereby reducing the maximum on/off ratio from the prior art of 32:1 from a fully off state to a fully on state during each frame. This more uniform duty cycle allows for conventional power recovery techniques to be applied, thereby providing enhanced operating efficiency for the AMEL display.

It will be appreciated that the number of passes per frame, number of illumination pulses per pass, and number of states in each illumination profile voltage signal disclosed are merely exemplary. Each of these parameters can be adjusted while still achieving the desired objectives of increased operating margin and substantially uniform pixel activation within a frame.

While the above method has been described in connection with a monochrome display, this method is also applicable to color displays. For example, 16 levels of color can be attained using 4-bit illumination profile voltage signals, resulting in 16 discrete profile states. An illumination pass is then associated with one of three colors, i.e., red, green and blue. By activating each color with 16 levels of illumination, a resulting color palette of over 4,000 colors is achieved. As with the monochrome display embodiment, each pass in a color display is preferably illuminated with a substantially equal number of illumination pulses as previously described. For example, to achieve an illumination profile voltage signal that passes thirty pulses in 16 profile states, the illumination profiles can include six (6) states passing one pulse each, six states passing 2 pulses each and four states passing 3 pulses each. In the case of a color display, the profile voltage signal for each pass in a frame can be the same.

Having described preferred methods and embodiments of the present invention, it is noted that modifications and variations can be made by persons skilled in the art in light of the above teachings. It is therefore to be understood that changes may be made in a particular embodiment of the invention disclosed which are within the scope and spirit of the invention as outlined by the appended claims.

What is claimed is:

1. A method of operating a pixel in an active electroluminescent matrix display for desired gray scale operation, said pixel including a first transistor coupled to an associated data line and to a select line, a second transistor connected to said first transistor, a load capacitor connected to both said first and said second transistors, and an electroluminescent cell connected to said second transistor, said method comprising the steps of:

dividing an illumination frame for said pixel into a plurality of passes, each of said passes including a load time period and an illumination time period;

applying pixel activation voltages to the data and select lines to load a voltage on said load capacitor during load time periods in each of said passes; and applying an illumination profile signal across said capacitor and said electroluminescent cell during illumination time periods in each of said passes, said illumination profile signals each including a discrete number of illumination profile states, said number being less than the number of possible gray scale states;

said illumination frame for said pixel being divided into three passes, each of said passes including thirty illumination pulses, and each illumination profile signal including six illumination profile states.

2. The method in accordance with claim 1, wherein said pixel activation voltages each corresponds to one of said illumination profile states.

* * * * *